US006003965A

United States Patent [19]

Arway et al.

[11] Patent Number: 6,003,965

[45] Date of Patent: Dec. 21, 1999

[54] INK AND SOLVENT CONTAINER FOR INK JET PRINTERS

[75] Inventors: George W. Arway, Norridge; Frank Eremity, Streamwood, both of Ill.

[73] Assignee: Videojet Systems International, Inc., Wood Dale, Ill.

[21] Appl. No.: 08/522,867

[22] Filed: Sep. 1, 1995

[51] Int. Cl.[6] ..... B41J 2/175; B41J 2/195; B41J 2/18

[52] U.S. Cl. ..... 347/7; 347/89; 347/85

[58] Field of Search ..... 347/7, 85, 86, 347/89, 90

[56] References Cited

U.S. PATENT DOCUMENTS

| | | | |
|---|---|---|---|
| 4,190,846 | 2/1980 | Yamamoto et al. . | |
| 4,542,386 | 9/1985 | Delligatii et al. . | |
| 4,555,712 | 11/1985 | Arway et al. | 346/75 |
| 4,595,933 | 6/1986 | Mayer | 347/89 |
| 5,406,320 | 4/1995 | Durst et al. | 347/86 |
| 5,424,766 | 6/1995 | Anderson | 347/7 |

FOREIGN PATENT DOCUMENTS

| | | | |
|---|---|---|---|
| 0 639 462 A2 | 2/1995 | European Pat. Off. . | |
| 0642924 | 3/1995 | European Pat. Off. | B41J 2/195 |
| 56-157391 | 12/1981 | Japan . | |
| 62-135371 | 6/1987 | Japan . | |
| 63-162251 | 7/1988 | Japan . | |
| 2025853 | 1/1980 | United Kingdom . | |

*Primary Examiner*—Valerie Lund
*Attorney, Agent, or Firm*—Rudnick & Wolfe; William T. Rifkin; R. Blake Johnson

[57] ABSTRACT

An ink and solvent supply consists of a dual-chambered container. The lower chamber is provided with make-up solvent, while the upper chamber is provided with ink concentrate. When solvent is required, it is removed directly from the lower chamber. When fresh ink is required, vacuum is applied to the upper chamber causing solvent to pass from the lower chamber to the upper chamber via a conduit, to dilute the ink concentrate to form fresh ink which is then provided to the printing system.

24 Claims, 5 Drawing Sheets

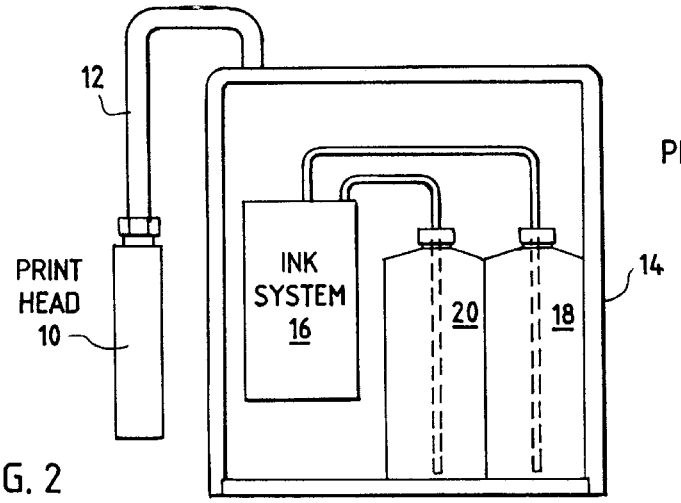
FIG. 1
PRIOR ART
FIG. 2
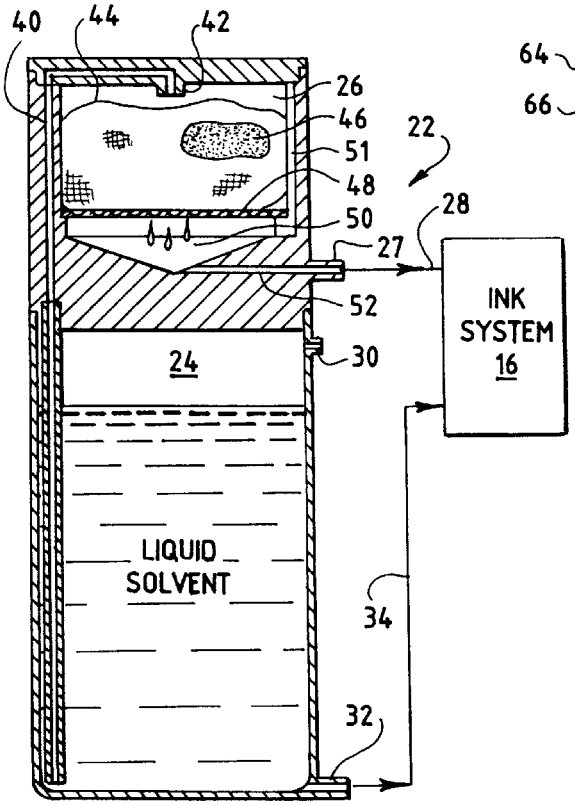
FIG. 3
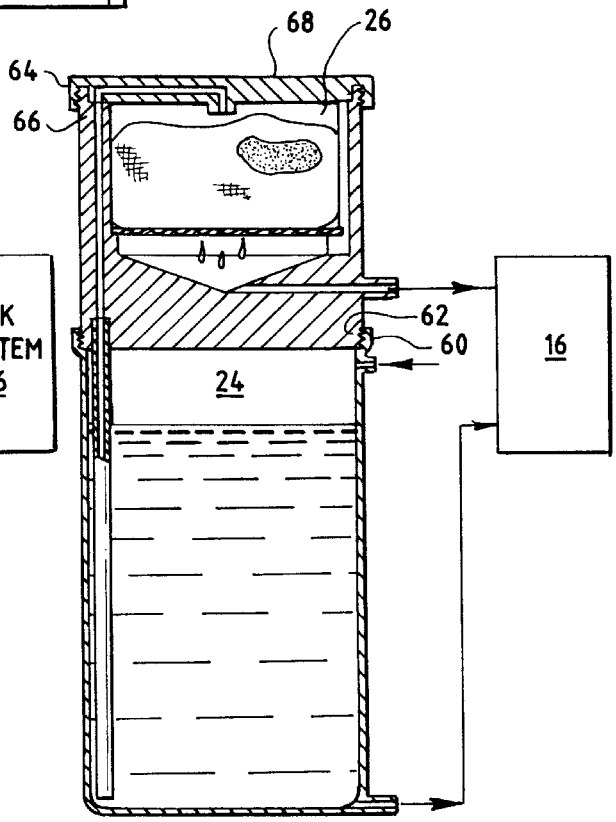

INK AND SOLVENT CONTAINER FOR INK JET PRINTERS

BACKGROUND OF THE INVENTION

This invention relates to ink jet printing in general and, in particular, to continuous jet printers. Such devices are used for high speed marking of alpha-numeric characters on a variety of substrates including consumer products which require date codes, for example. Continuous jet systems operate by deflecting selected drops of ink onto the substrate to be marked while returning the unused drops to the print system for reuse. As the ink is consumed, it is necessary to provide fresh ink to the printer. In addition, it is periodically required to provide replacement solvent to compensate for losses due to evaporation thereby to keep the ink composition relatively stable.

Accordingly, in most ink jet systems, there is provided a solvent container from which the system draws solvent when required and a separate ink container from which fresh ink is drawn as needed. The printing system itself typically contains a micro-processor based controller which employs various techniques to measure ink composition, quantity, viscosity and/or temperature to determine when solvent and/or fresh ink needs to be added. When the need is detected, valves are operated to draw solvent or ink or both from the containers into the ink operating system.

One example of such a system is disclosed in U.S. Pat. No. 4,555,712 to Arway assigned to the present assignee. In this patent, as shown in FIG. 2, there is a solvent container 58 and a fresh ink container 56 operated by an electronic controller 34 to add supplies to the ink jet system. A greatly simplified illustration of such a printer system according to the prior art is shown in FIG. 1 of the present application.

While the two container system works quite well in practice, there are certain disadvantages. Maintenance activities are frequent because the ink and solvent are typically consumed at different rates and thereby require replenishment at different times. A related problem is the need for users to stock and handle two different supply products for the same machine. In that connection, because the containers typically are physically the same but labeled differently, it is possible to inadvertently interchange the connections to the printer system so that solvent is drawn into the system when ink has been requested and vice versa. Such a mix-up causes faulty operation and down time for servicing of the printer. Another problem with a two container supply system is the potential spilling of liquid ink during installation. The present invention is an improvement over prior art systems which use two supply containers in that a single volume of solvent is used to create fresh ink and for solvent replenishment.

It has been suggested in the prior art to provide a single supply system for drop-on-demand ink jet printing. Such a system is disclosed in European Patent application No. 941 068 14.0 to Due published Mar. 15, 1995 (Publication Number 0642924A2). The Due application discloses, at FIGS. 1 and 2, a housing having a collapsible ink concentrate container provided therein. Fluid, preferably water from a water supply, is introduced into the housing to apply pressure to the ink concentrate container. Concentrate is forced from the container to a mixing manifold forming a portion of the housing. At the manifold, the water and ink concentrate are mixed and thereafter supplied to an ink jet printer. In the embodiment shown in FIG. 4 of Due, a switchable system is illustrated in which an empty system can be replaced without interrupting printing.

The present invention is an improvement over Due in several important respects. Due appears to be limited to installations employing a pressurized fluid supply, i.e., a water supply. Further, this device provides only fresh ink, not a separate supply of solvent because it is intended for a drop-on-demand printing system not a continuous jet system. Thus, it lacks any provision for solvent to make up for evaporative solvent losses.

It is accordingly an object of the present invention to overcome these and related problems and to simplify the method of providing solvent and fresh ink to the printer system.

It is a further object of the invention to provide a system whereby an ink jet printer can be operated over extended periods of time by periodic replacement of a single, integrated supply containing both solvent and fresh ink.

It is a further object of the invention to produce fresh ink on demand to avoid ink spills or spoiling or contamination before use. These and other objects of the invention will be apparent from the remaining portion of the specification.

BRIEF DESCRIPTION OF THE DRAWINGS

FIG. 1 is an illustration of a typical ink jet printing system in the prior art having separate solvent and ink supply containers.

FIG. 2 is a cross-sectional view of a first embodiment of the invention illustrating the details thereof.

FIG. 3 is a modification of the first embodiment formed in two detachable sections.

DETAILED DESCRIPTION

Figure 4:
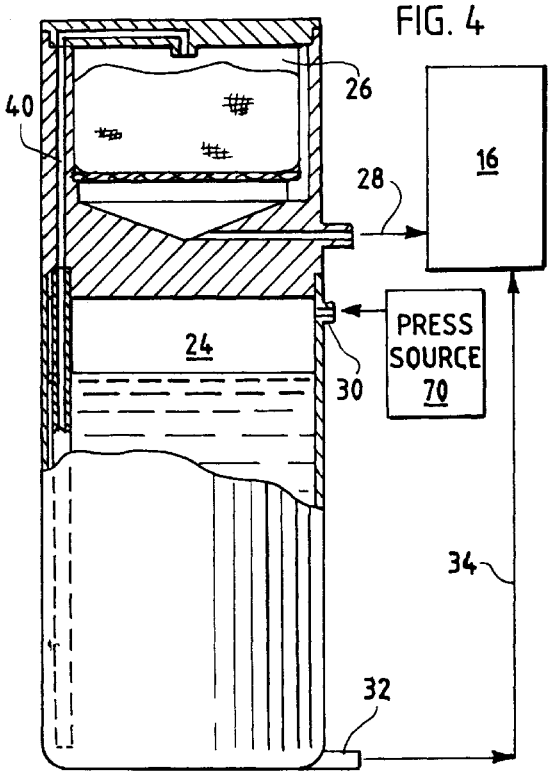
FIG. 4 is a further modification of the invention utilizing a pressure source rather than a vacuum source.

Referring to FIG. 1 a typical, continuous jet system is illustrated in block form. The system includes a printhead 10 provided with a supply of ink via a cable 12 from the main printer control and supply cabinet 14. Located within the cabinet 14 is the ink system control module 16 containing the usual valves, vacuum sources and control electronics found in a modern continuous jet ink jet printer system of the type, for example, disclosed in U.S. Pat. No. 4,555,712, hereby incorporated by reference. When the ink control module 16 detects that the ink supply requires replenishment, it utilizes a pressure differential in the form of either a vacuum line or a high-pressure line to transport ink from a fresh ink supply bottle 18 into the system. Similarly, if, due to evaporative losses, the ink in the system is determined to require additional solvent, solvent is transported into the system from supply bottle 20. In this way, the quantity of the ink in the printer system can be maintained within acceptable limits. The composition of the ink is also maintained substantially within acceptable quality limits by adding replacement solvent. Periodically, it is necessary to replace the ink and solvent containers 18 and 20 and when doing so, it may be necessary to shut down the printer system. In typical industrial and commercial applications, down time on a printer is undesirable and is to be avoided. Because there are two separate reservoirs and because the use rates of the fluids contained in the reservoirs differ, it is usually necessary to replace these containers at different times resulting in additional servicing. In addition, because the containers are virtually identical in shape and function, it is possible to confuse a solvent container with an fresh ink container and to install them incorrectly, resulting in the need to shut down the printer for corrective maintenance.

According to the present invention, these disadvantages and the others mentioned in the background, are overcome by use of an integrated solvent and ink container of the type shown in FIG. 2. This device replaces both the ink container 18 and the solvent container 20 of FIG. 1. In addition, because it does not employ ready to use liquid ink, but rather a more stable concentrate, the shelf life of the product is markedly extended. Referring now to FIG. 2, a first embodiment of the invention is illustrated. The invention consists of a container generally indicated at 22 intended to be connected to the ink system 16 of a continuous jet ink jet printer. The container 22 consists of a lower reservoir 24 intended to contain a supply of solvent and an upper reservoir 26 intended to contain a supply of viscous ink concentrate or dry, granular ink concentrate. The upper and lower reservoirs, in this embodiment, are formed within a single housing. Three external ports are provided to communicate with the interior of the device. Port 27 permits reconstituted liquid ink to flow to the ink system 16 via a line 28. Port 30 is a vent port permitting atmospheric pressure to equalize the pressure inside the lower chamber 24. Port 32 permits the withdrawal of solvent directly from chamber 24 for supply to the ink system 16 via line 34.

The container 22 includes a passageway 40 communicating the upper chamber 26 with the lower chamber 24. Passageway 40 terminates, at its upper end, in a port 42 disposed at the top of the upper chamber 26. Passageway 40 terminates, at its lower end, near the bottom of chamber 24.

Disposed within upper chamber 26 is a supply of ink concentrate. As indicated previously, the concentrate may be in the form of a viscous ink concentrate, or it may take the form of a dry, granular ink powder. In either case, it is preferably provided within an enclosed liquid permeable receptacle 44. The membrane may be formed of cellulose based filter material such as the type commonly used for coffee filter applications. The ink concentrate 46 contained within the receptacle 44 is supported within the upper chamber 26 on a support element 48. Support element 48 is also liquid permeable and is preferably formed from a piece of metal screening and/or from a disk of filter material.

Beneath the support element 48 is a conical shaped receptacle so into which reconstituted liquid ink drops prior to entering a conduit 52 which communicates with port 27.

Operation of the device shown in FIG. 2 is as follows. In the event that solvent is required, a vacuum or pressure differential is applied to line 34 by the ink system 16. This draws solvent from the lower reservoir 24 through port 32 to the ink system. In the event that fresh ink is required, vacuum or pressure differential is applied via line 28. The pressure difference is communicated to the upper chamber 26 via receptacle 50 and, preferably, via a conduit 51 which prevents the ink concentrate from blocking air flow. As a result, solvent is drawn into chamber 26 via conduit 40 from the lower chamber 24. It is discharged from port 42 onto the membrane 44 containing the ink concentrate 46. The solvent mixes with or dissolves a portion of the concentrate forming a reconstituted fresh ink supply which easily passes through the porous openings of the permeable membrane 44. The ink drops also pass through the openings in the support element 48 and into the collection receptacle 50. From there it is drawn through the conduit 52 to port 27 where it is supplied to the ink system 16.

Thus, the present invention, can supply either solvent or fresh ink to the ink jet printer system or both simultaneously, as was the case with the prior art system in which two separate supply containers were required. The present invention, however, requires only one container, preventing the possibility of mix-up of the containers and also reducing the need for extra maintenance. Because only a single container is required, less space is necessary in the printer cabinet. A further significant point is that because ink is made fresh "on demand" the shelf life is extended.

Referring to FIG. 3, a second embodiment of the invention is illustrated. This embodiment functions identically to the embodiment of FIG. 2, but differs in the construction of the container itself. More specifically, the FIG. 3 embodiment, has the upper chamber 26 removably connected to the lower chamber 24. For that purpose, threadably engageable surfaces 60 and 62 are provided. Similarly, threadably engageable surfaces are provided at 64 and 66 so that the top 68 of the upper chamber may be removed. It will be obvious to those skilled in this art that by providing screw threads at these locations, it is possible to refill the container 22 for reuse. Thus, by separating the chambers an additional supply of solvent can be placed into the lower chamber 24 and after it is reassembled, the top 68 of the upper chamber can be removed to replace the ink concentrate supply. Also, if desired it is possible to construct an embodiment of this invention in which the chambers are located apart from one another.

Referring to FIG. 4, a third embodiment is illustrated. In this embodiment, the structure of the container 22 is identical to the structure of FIG. 1. In this embodiment, however, a positive pressure source 70 is employed, via port 30, to operate the device in place of using vacuum pressure on lines 28 and 34. In operation, if solvent is desired, pressure is applied to port 30, while line 34 has a slight vacuum applied to it or is simply open so that the pressure differential between ports 30 and 32 will drive solvent from the lower reservoir 24 to the ink system 16. Solvent will not flow through the conduit 40 during this operation, but, it is preferable to close line 28 to prevent any solvent being forced into the upper chamber.

Alternatively, when it is desired to reconstitute ink and supply it to the system, this is accomplished by applying pressure at port 30 and opening line 28. In all other respects, this embodiment operates in the same manner as the first two embodiments.

Figure 5:
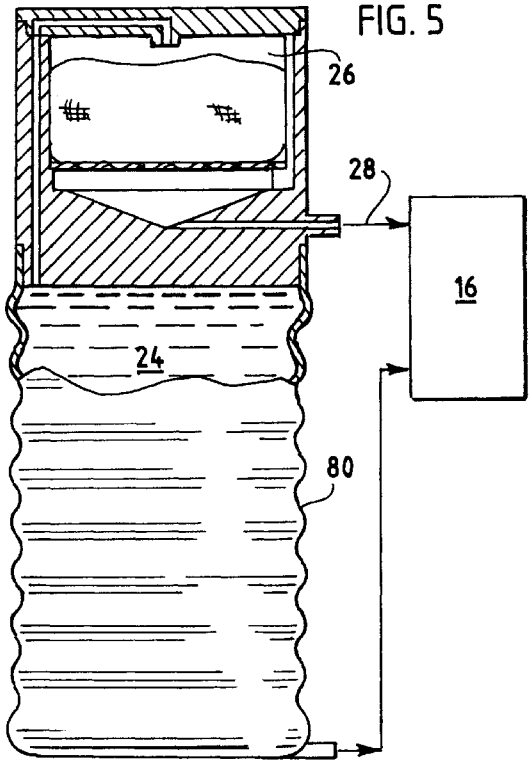
FIG. 5 is a further modification of the invention employing a flexible solvent reservoir to eliminate the need for a vent port.

Referring to FIG. 5, there is shown a further embodiment of the invention in which the solvent reservoir is formed of deformable or collapsible material. This embodiment eliminates the need for the port 30 of the first embodiment. More specifically, as the liquid solvent is withdrawn from the chamber 24, the walls 80 of the lower chamber collapse or contract to prevent forming a vacuum which would interfere with the flow of solvent either to the ink system 16 or to the upper chamber 26. To form a collapsible lower portion, the walls 80 should preferentially be made of a soft material, such as any of the commercially available plastics which are resistant to the chemicals founds in commercial ink solvent. The provision of corrugations or a bellows structure facilitates the collapsing function as solvent in the reservoir is consumed.

Figure 6:
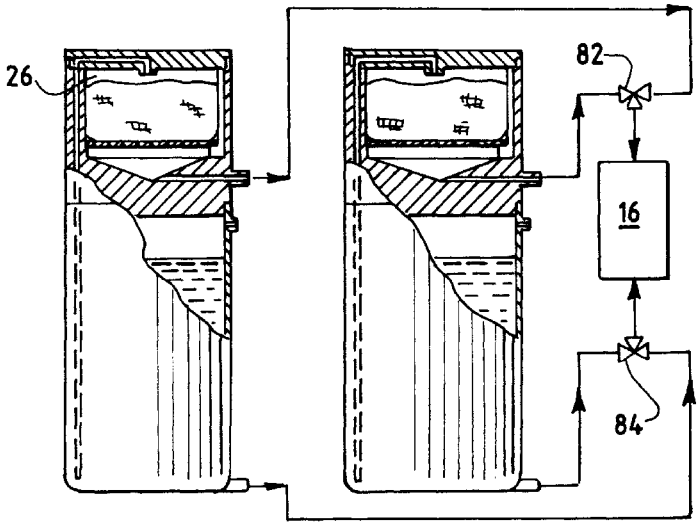
FIG. 6 illustrates a dual system in which substantially uninterrupted printing can be obtained by switching between containers during the period of time necessary for container replacement.

FIG. 6 illustrates a dual supply system in which the space saved by utilizing a combined ink and solvent container of the present invention is utilized to double the supply capacity. In the dual system, it is possible to provide continuous ink jet printer operation by manually or automatically switching between containers when one is detected to be empty. Thus, when an empty container is detected, a switch over is made so that operation of the printer may continue uninterrupted. The empty container may then be replaced with a full one so that there is never a period of time when the ink system cannot obtain additional supplies of solvent and fresh ink. More specifically, in FIG. 6, dual containers 22 are connected in parallel to the ink system 16 by way of three-way valves 82 and 84. Assuming the left container is supplying ink and solvent to the system, the valves will be in a position to communicate the fluids from that container. When the ink system 16 detects that fluid is no longer flowing from this container, because it is out of solvent, the three-way valves 82 and 84 are operated to switch to the right container thereby to continue supplying solvent and ink to the ink system 16. Preferably when the switch over occurs, a signal is provided to the system operator to change out the empty container.

Figure 7:
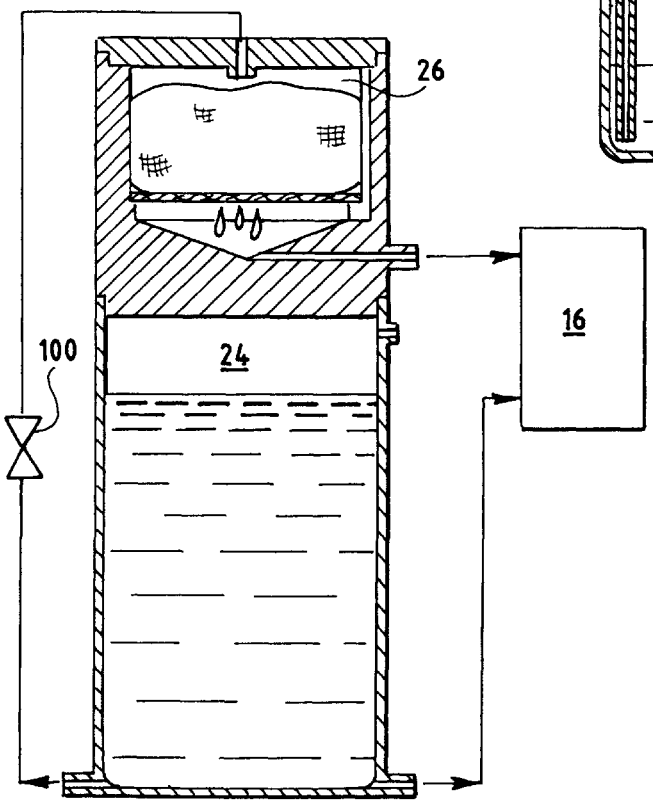
FIG. 7 illustrates a modification of the FIG. 2 embodiment including a valve in the fluid path between the reservoirs.

Referring to FIG. 7, a modification of the FIG. 2 device is illustrated. In this embodiment, a valve 100, is disposed in the flow path between the solvent chamber 24 and the ink chamber 26. Valve 100 is controlled by the ink control system 16. The purpose of the valve is to provide better control over entry of solvent into the ink chamber. Specifically, it is desirable to prevent the entry of excess solvent into the ink chamber as may sometimes occur due to the residual vacuum which may exist in the ink chamber 26. Thus, without valve 100, it is possible that residual vacuum may create a "syphon" effect causing the entire ink chamber 26 to fill with solvent either during or after the delivery of additional ink to the ink system.

To prevent this undesirable possibility positive control of the flow of solvent to the ink chamber is provided by means of valve 100 which is only open when it is desired to draw solvent into the chamber 26. Otherwise, the valve remains closed preventing any undesired flow.

Figure 8:
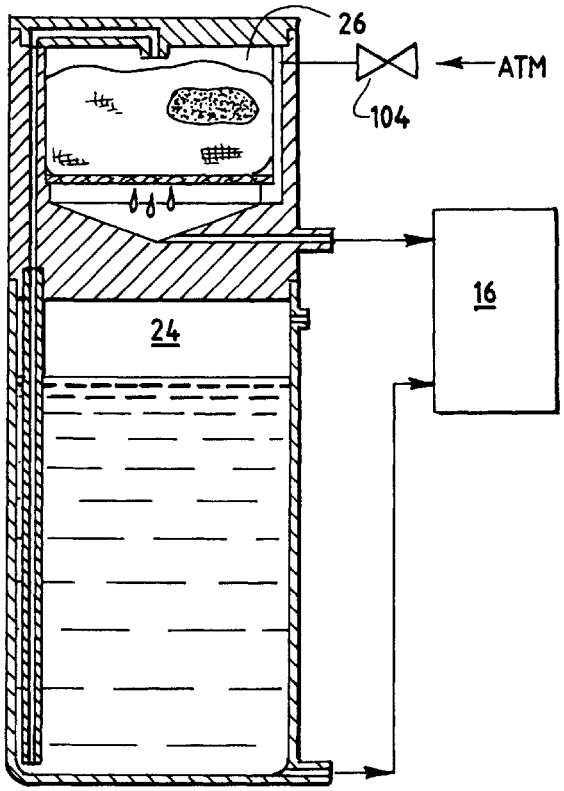
FIG. 8 illustrates a modification of the FIG. 2 embodiment including a valve for equalizing the pressure in the upper chamber.

Referring to FIG. 8, another solution to the undesired flow problem is illustrated. In this embodiment, a valve 104, is used to equalize the pressure in the chamber 26 to eliminate any residual vacuum thereby to avoid "flooding" the ink chamber. Thus, the FIG. 8 embodiment operates in the same manner as the FIG. 2 embodiment except that valve 104 is closed when it is desired to draw solvent into the ink chamber and opened to equalize the chamber pressure when the operation is complete to prevent further flow of solvent thereto.

Figure 9:
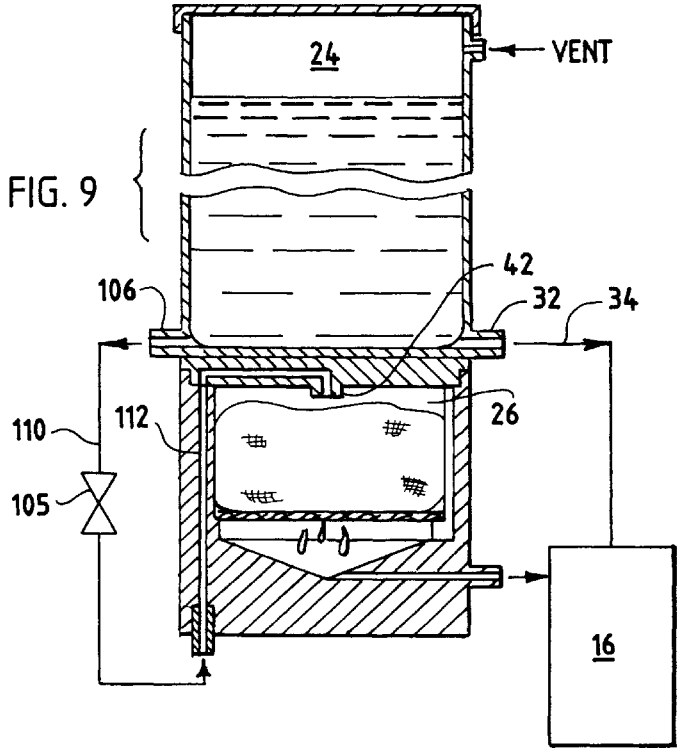
FIG. 9 illustrates a further modification of the invention in which gravity is used to transport solvent to the ink reservoir.

FIG. 9 is a further embodiment of the invention in which the ink chamber 24 is disposed below the solvent chamber 26 thereby to employ gravity flow to draw solvent into the ink chamber. In this embodiment solvent can be drawn directly from the chamber 24 by the ink system 16 via port 32 and line 34. When ink is required, a valve 105 is operated permitting solvent to flow from port 106 to port 108 via line 110. Because the solvent supply is disposed above the ink reservoir, solvent will flow upwardly in conduit 112 to port 42 and into the ink chamber 26. Because gravity flow is used to convey the solvent to the ink chamber, positive control of the flow is required by operation of valve 105. In all other respects, this embodiment is similar to FIG. 2.

Figure 10:
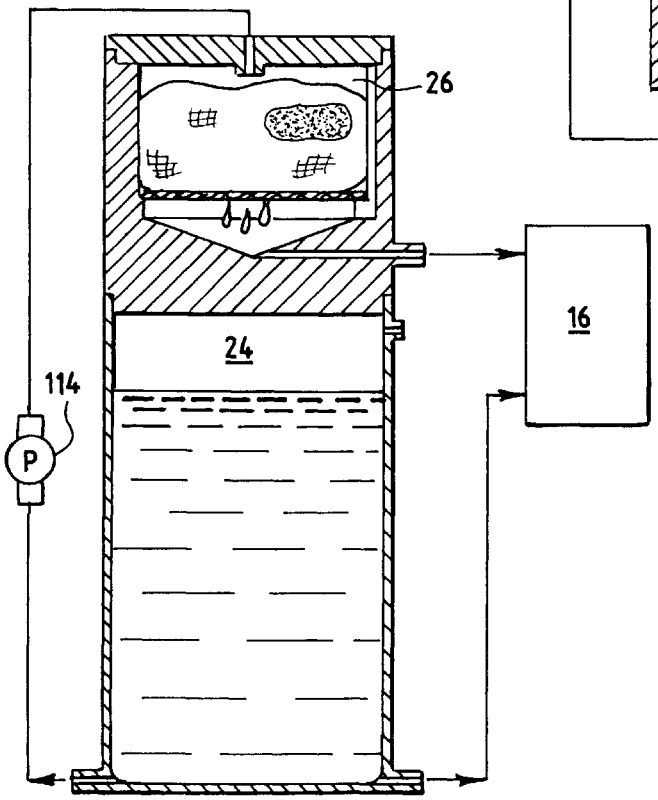
FIG. 10 is a modification of the FIG. 2 embodiment employing a pump to convey solvent to the upper chamber.

FIG. 10 is a variation of the FIG. 2 embodiment in which a pump 114 is used to convey solvent from the solvent chamber 24 to the ink chamber 26. This provides positive control over the flow of solvent and prevents inadvertent flooding of the ink chamber due to residual vacuum.

Figure 11:
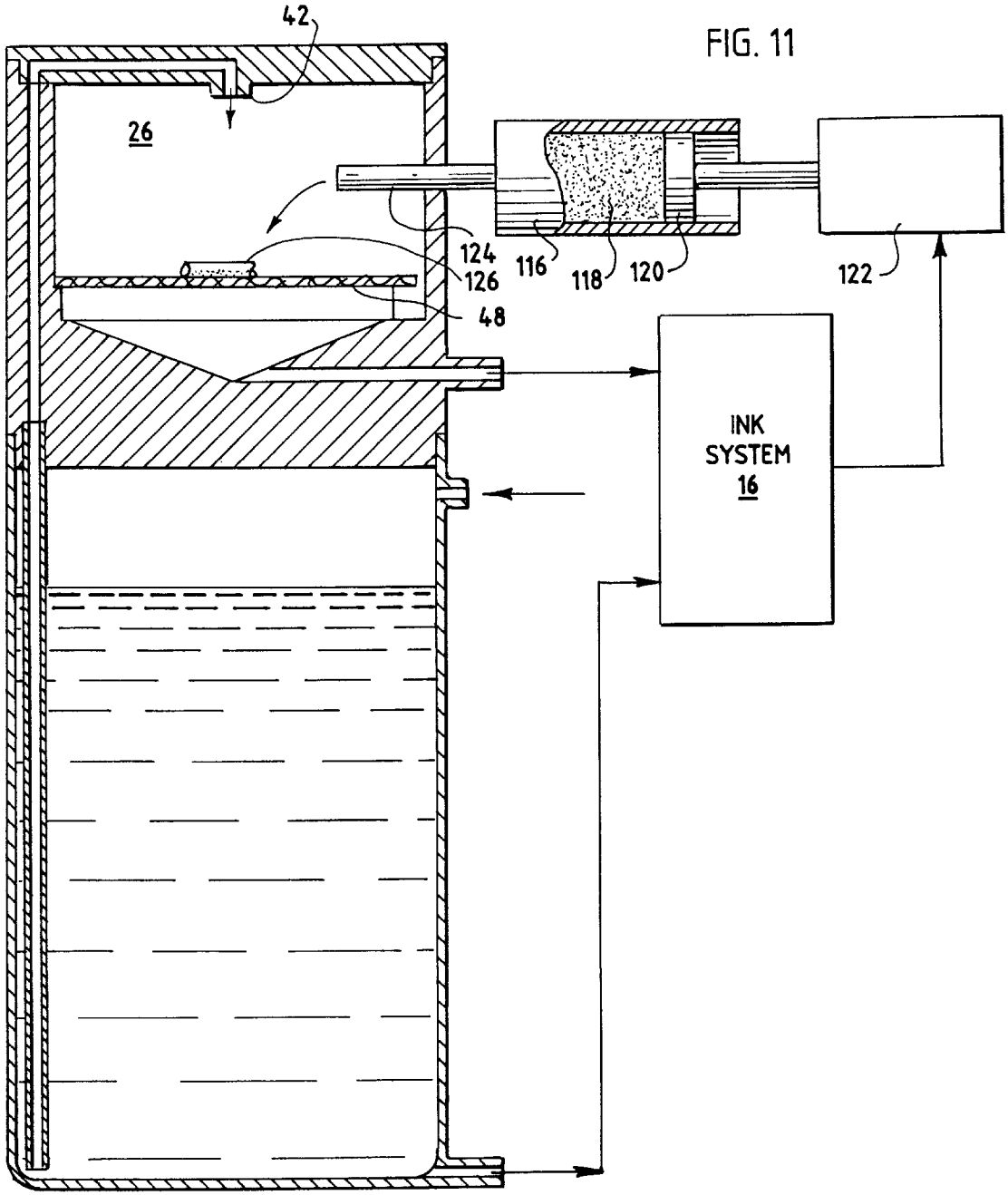
FIG. 11 is a further modification of the invention in which a separate chamber is utilized to eject concentrate into the ink chamber when necessary.

FIG. 11 is a further embodiment of the invention in which the membrane containing an ink concentrate is omitted. Instead, a separate container or receptacle 116 is provided having the ink concentrate 118 disposed therein. Plunger 120, preferably operated by solenoid 122 under control of the ink system 16, "extrudes" a measured amount of ink concentrate into chamber 26 via nozzle 124. The concentrate "pellet" 126 rests on the screen floor 48 and is exposed to solvent from port 42 when it enters the chamber. In operation it will be apparent that the concentrate injector solenoid is first operated to provide a concentrate pellet in the ink chamber. Solvent is then drawn into the chamber to mix with the concentrate and create fresh ink. This embodiment has the advantage of permitting precise control of the quantities of concentrate and solvent which may result in increased economy.

With respect to the ink concentrate provided in the upper chamber, it is preferred that it be of a semi-solid, tar-like consistency. This facilitates reconstituting it to a liquid ink when required. To make ink concentrate of this consistency, the usual dyes present in ink are mixed with enough solvent to homogenize the mixture. Solvent is then evaporated to the point of achieving the tar-like consistency desired. As indicated previously, it is also possible to use a dry or powder ink concentrate. The use of a fluid permeable container to hold the ink and/or as a support for the ink concentrate ensures that the reconstituted ink is properly homogenized before it is supplied to the ink system.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed:

1. A container for dispensing liquid ink and ink solvent to an ink jet printer comprising:

a) a solvent chamber containing a quantity of solvent and including means for communicating said solvent to said printer;

b) an ink chamber containing an ink concentrate which, when diluted with solvent, produces a quantity of liquid ink;

c) means for communicating the liquid ink from said ink chamber to said printer; and d) means for conducting solvent from said solvent chamber to said ink chamber to dilute said ink concentrate to produce liquid ink.

2. The container of claim 1 wherein the means for communicating solvent to said printer includes a port in said solvent chamber connected to said printer by a conduit, a pressure differential applied to said conduit causing solvent to flow to the printer.

3. The container of claim 1 wherein said ink concentrate is disposed within said ink chamber on a liquid permeable support.

4. The container of claim 3 wherein said ink concentrate is disposed within said ink chamber in a liquid permeable receptacle disposed on said support.

5. The container of claim 1 wherein said ink concentrate is disposed within said ink chamber in a liquid permeable receptacle.

6. The container of claim 1 wherein said means for communicating the liquid ink includes an ink receptacle and a port connected to said printer by a conduit, a pressure differential being applied to said conduit to cause liquid ink to flow to the printer.

7. The container of claim 1 wherein said means for conducting solvent from said solvent chamber to said ink chamber includes a conduit, one end of which is disposed in said solvent chamber, the other end communicating with a port in said ink chamber, whereby a pressure differential applied to said port introduces solvent into the ink chamber to mix with said ink concentrate to produce liquid ink.

8. The method of claim 7 wherein said port for communicating solvent to said ink chamber is disposed above said ink concentrate.

9. The container of claim 1 wherein said container is formed as a single unit.

10. The container of claim 1 wherein said container is formed as two units releasably secured together to permit refilling of the solvent and ink chambers, said ink chamber including a removable cover portion for such purpose.

11. The container of claim 1 wherein said solvent chamber is formed of a flexible material to permit it to collapse as solvent is withdrawn therefrom.

12. An ink system for an ink jet printer comprising:

a) a container for dispensing liquid ink and ink solvent including:

i) a solvent chamber containing a quantity of solvent and including means for communicating said solvent to said printer;

ii) an ink chamber containing an ink concentrate which, when diluted with solvent, produces a quantity of liquid ink;

iii) means for communicating liquid ink from said ink chamber to said printer;

iv) means for conducting solvent from said solvent chamber to said ink chamber to dilute said ink concentrate to produce liquid ink;

b) means for selectively withdrawing liquid ink and solvent from said container.

13. The system of claim 12 wherein said means for selectively withdrawing includes:

a) means for applying a pressure differential to the solvent chamber to withdraw solvent;

b) means for applying a pressure differential to the ink chamber to draw solvent from the solvent chamber into the ink chamber to produce ink from said ink concentrate, said differential thereafter causing withdrawal of said liquid ink.

14. The system of claim 12 wherein two containers are provided and wherein said means for selectively withdrawing includes valve means for switching containers when a container in use is empty.

15. The system of claim 12 wherein said means for communicating the liquid ink includes an ink receptacle and a port connected to said printer by a conduit, the creation of a pressure differential in said conduit causing liquid ink to flow to the printer.

16. The system of claim 12 wherein said means for conducting solvent from said solvent chamber to said ink chamber includes a conduit, one end of which is disposed in said solvent chamber, the other end communicating with a port in said ink chamber, whereby a pressure differential applied to said port introduces solvent into the ink chamber to mix with said ink concentrate to produce liquid ink.

17. The system of claim 12 wherein said container is formed as a single unit.

18. The system of claim 12 wherein said solvent chamber is formed of a flexible material to permit it to collapse as solvent is withdrawn therefrom.

19. A container adapted to supply ink to an ink handling system of a printer for delivery to a printhead, the ink formulated from concentrate diluted with solvent, comprising in combination:

a) a first chamber for retaining the undiluted concentrate;

b) a second chamber for retaining the solvent;

c) a passageway for transmitting solvent from said second chamber to said first chamber to mix with the undiluted concentrate to make ink;

d) a collector receptacle associated with said first chamber for collecting the ink that is produced by the mixing of solvent and concentrate; and e) a port connected to said collector receptacle for transferring said ink to said ink handling system.

20. The container of claim 19 further including:

a) a fluid permeable membrane in which the concentrate is disposed.

21. The container of claim 19 further including:

a) a second outlet connected to said second chamber for transferring solvent to the ink handling system of the printer.

22. A container as in claim 19 further including:

a) means for establishing a pressure difference between said first chamber and said second chamber to drive solvent to said first chamber.

23. A container as in claim 19 further including:

a) means associated with the ink handling system for drawing solvent into said first chamber and providing ink to the ink handling system.

24. A container adapted to supply ink to an ink handling system of a printer for delivery to a printhead, the ink formulated of concentrate and solvent, comprising in combination:

a) a first upper chamber for retaining the concentrate, said chamber having a liquid permeable floor;

b) a collector receptacle to collect ink that passes through said permeable floor;

c) a second lower chamber separated from said first chamber for retaining solvent;

d) a first passageway transmitting solvent from said second chamber to said first chamber to mix with the concentrate to make ink;

e) a second passageway connected to said collector receptacle for transferring the collected ink from the container.

* * * * *